US006431017B1

(12) United States Patent
Robadey

(10) Patent No.: US 6,431,017 B1
(45) Date of Patent: Aug. 13, 2002

(54) MECHANISM FOR MOVING TWO ALIGNMENT DEVICES SIMULTANEOUSLY IN OPPOSITE DIRECTIONS

(75) Inventor: Pierre Robadey, Pompaples (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 09/527,669

(22) Filed: Mar. 17, 2000

(30) Foreign Application Priority Data

Apr. 1, 1999 (CH) ..... 0630/99

(51) Int. Cl.[7] ..... F16H 21/18
(52) U.S. Cl. ..... 74/45; 74/60; 74/567
(58) Field of Search ..... 74/45, 60, 99 R, 74/101, 102, 104, 567, 570

(56) References Cited

U.S. PATENT DOCUMENTS

| | | | | |
|---|---|---|---|---|
| 3,539,748 A | * | 11/1970 | Neumeier | 200/153 |
| 5,074,325 A | * | 12/1991 | Rumberger et al. | 137/15 |
| 5,562,560 A | * | 10/1996 | Kanamaru et al. | 475/163 |
| 5,634,634 A | | 6/1997 | Dobbertin et al. | |
| 5,794,513 A | * | 8/1998 | Kristensen | 92/57 |

FOREIGN PATENT DOCUMENTS

| | | |
|---|---|---|
| EP | 0936170 | 8/1999 |
| FR | 2251506 | 6/1975 |

OTHER PUBLICATIONS

International Search Report dated Feb. 14, 2002 for Application No. EP 00 10 4209.

* cited by examiner

*Primary Examiner*—David Fenstermacher
(74) *Attorney, Agent, or Firm*—Ostrolenk, Faber, Gerb, & Soffen, LLP

(57) ABSTRACT

A mechanism for moving two alignment devices having vertical parallel faces for identical flat workpieces such as cardboard blanks, simultaneously in opposite directions. The mechanism includes two reciprocating slides that simultaneously drive the alignment devices in opposite directions. The slides are operated by an articulated mechanism including a pair of extension arms and a drive cradle attached to an oscillating shaft. Actuate projections on the drive cradle engage rotationally with complementary arcuate surfaces on coupling mechanisms, preferably formed of a plastic material such as PETP, attached to the extension arms as the shaft oscillates. Compression springs bias the extension arms and the associated coupling mechanisms against the projections to eliminate the effect of wear in the mechanism.

9 Claims, 2 Drawing Sheets

MECHANISM FOR MOVING TWO ALIGNMENT DEVICES SIMULTANEOUSLY IN OPPOSITE DIRECTIONS

BACKGROUND OF THE INVENTION

1. Field of the Invention

The present invention relates to a device for aligning a stack of flat workpieces, and more particularly to a mechanism for moving two alignment devices simultaneously in opposite directions. Such alignment devices have vertical parallel faces for stacking identical flat workpieces having two opposite parallel faces, and are operated by an oscillating drive mechanism through two respective parallel slides secured to the drive mechanism by respective toggle mechanisms.

One application of the invention is in the package-making industry. Cardboard packages for products such as cigarettes are printed on their surfaces, then creased along intended folding lines and, finally, accurately die-cut to the required external shape. In this state, they are delivered to the cigarette manufacturer where they will be shaped during the processing operation of the cigarettes. However, after performance of the above-mentioned operations i.e., the printing, creasing, and die-cutting, the flat blanks have to be stacked at the end of the production line.

2. Related Art

Conventional equipment for this application employs alignment devices having vertical parallel faces arranged on opposite sides of the stack of flat workpieces, for simultaneously applying two opposed pressures on the accumulating stack in order to align the opposed edges of the flat workpieces.

It is very difficult to control the alternating movements of the two alignment devices in perfect phase opposition, i.e., so that the aligning forces are applied and withdrawn simultaneously. It is important to do so, however, because a slight phase difference imparts an oscillating movement to the stack which, finally, threatens to fall.

To avoid this problem, it has been proposed to connect the alignment devices with an oscillating driver by two respective parallel slides, articulated with regard to the driver around two respective toggle axles which are symmetrical and parallel to the oscillating axle of the driver. Such a solution ensures, initially, the required synchronism between the jointed axles and the jointed pieces on these axles until a clearance appears by wear. As this clearance increases, the phase difference between the operation of alignment devices increases, and hence, the problem reappears.

BRIEF SUMMARY OF THE INVENTION

The aim of the present invention is to meet, at least partly, the aforementioned drawbacks.

According to the invention, there is provided a mechanism for moving two alignment devices having vertical parallel faces for stacking identical flat workpieces, simultaneously in opposite directions. The mechanism includes two reciprocating slides that simultaneously drive the alignment devices in opposite directions. The slides are operated by an articulated mechanism including a pair of extension arms and a drive cradle attached to an oscillating shaft. Arcuate projections on the drive cradle engage rotationally with complementary arcuate surfaces on coupling mechanisms attached to the extension arms as the shaft oscillates. Compression springs bias the extension arms and the associated coupling mechanisms against the projections to eliminate the effect of wear in the mechanism.

BRIEF DESCRIPTION OF THE DRAWINGS

The enclosed drawing illustrates, schematically and by way of example, an embodiment of the device that is object of the present invention.

DETAILED DESCRIPTION OF THE INVENTION

Figure 1:
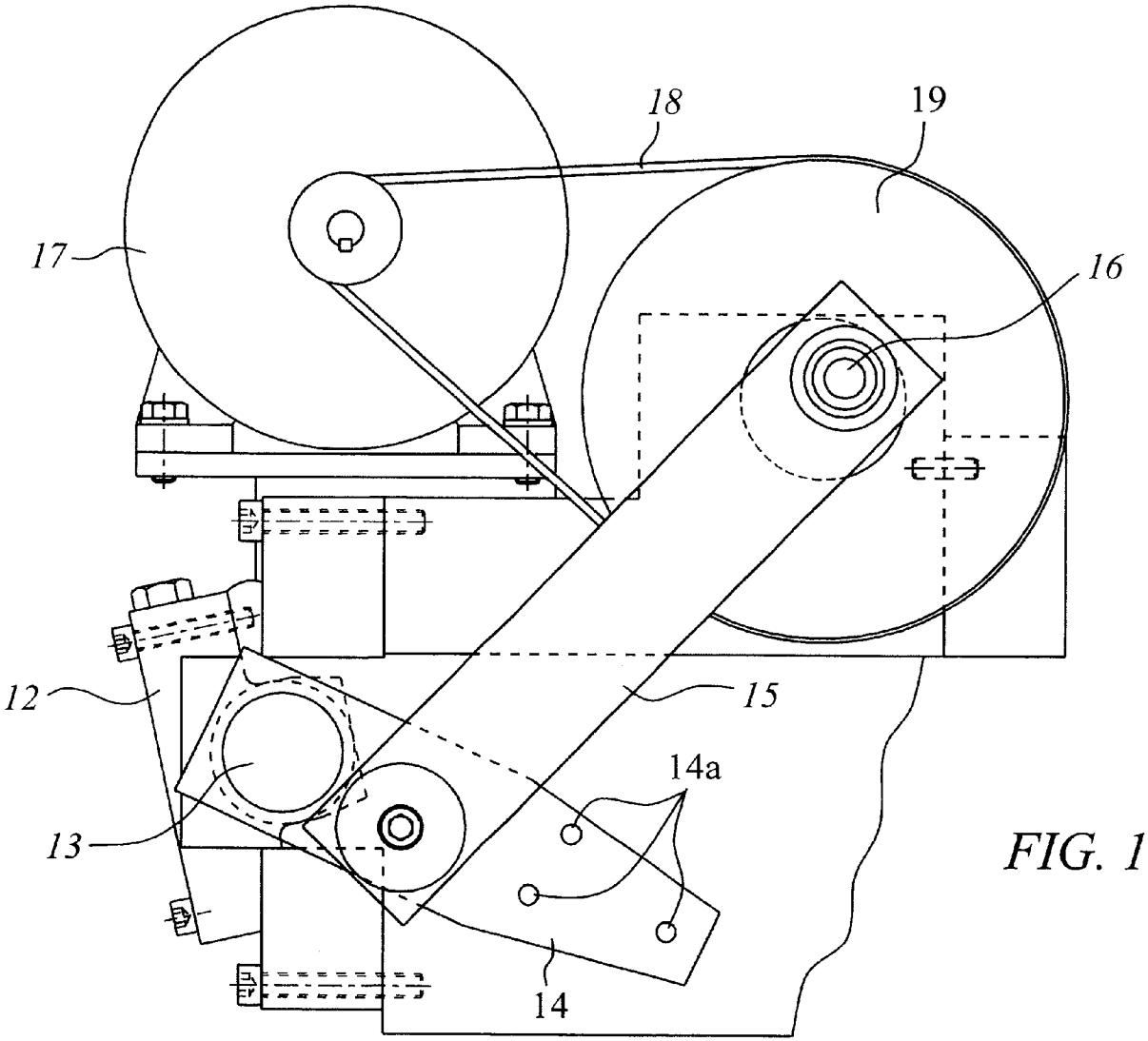
FIG. 1 is a top view of the drive mechanism.
Figure 2:
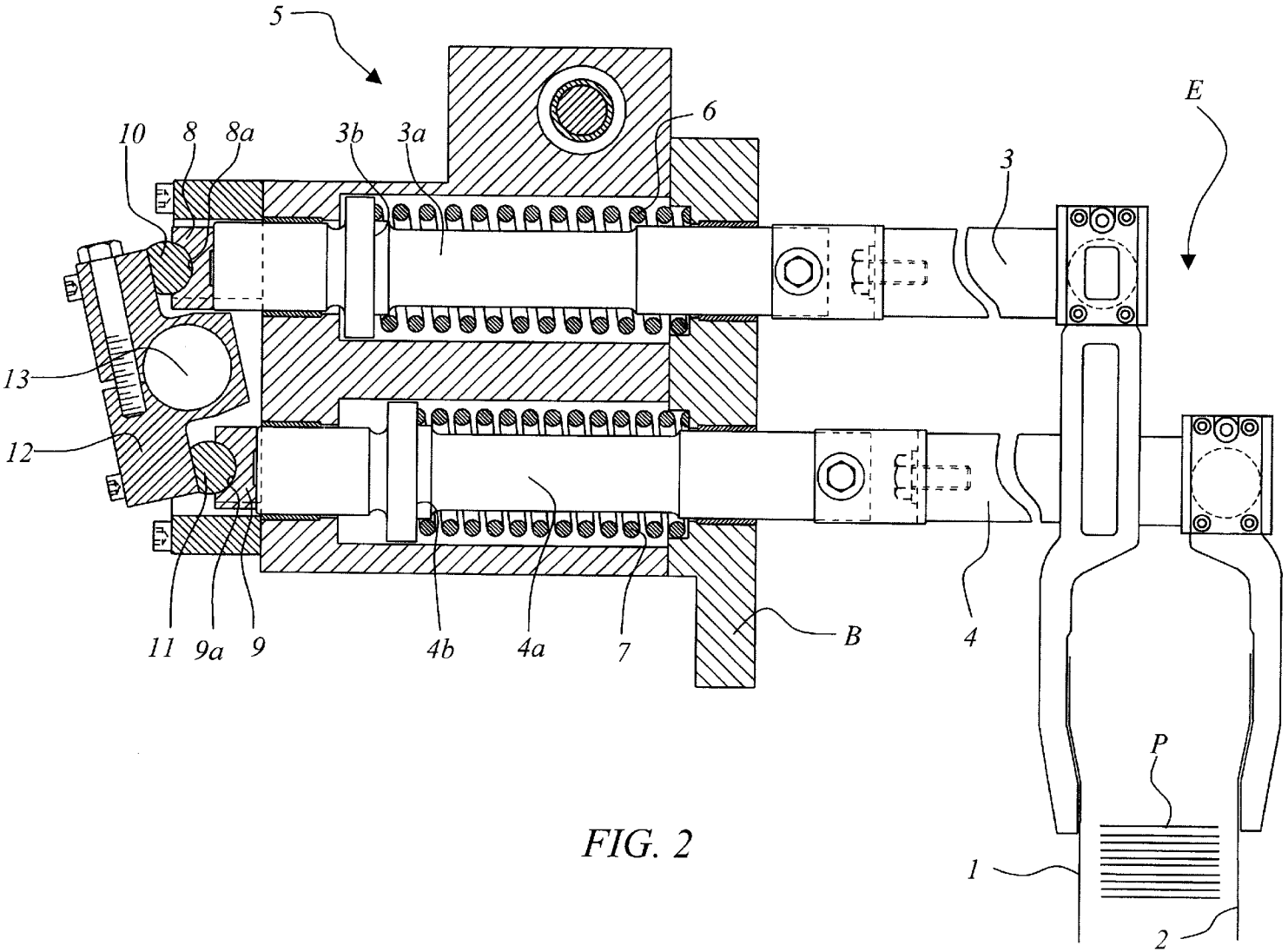
FIG. 2 is a sectional view in a plan parallel to FIG. 1 of this drive mechanism of the alignment devices.

As illustrated in FIGS. 1 and 2, a stacking module E receives a succession of flat blanks which are to be formed into a stack P. The alignment of the two lateral sides of the stack is obtained by simultaneously exerting two opposed pressures on the accumulating stack by two vertical parallel alignment devices 1 and 2 arranged on opposite sides of the stack. This is well known by those skilled in the art and is not part of the present invention, and therefore, further detailed description is omitted.

Two horizontally movable arms or slide mechanisms 3 and 4 impart the required motion to alignment devices 1 and 2. Slide mechanisms 3 and 4 are respectively connected at first ends thereof to alignment devices 1 and 2 respectively. The opposite ends of slide mechanisms 3 and 4 are attached to respective extension arms 3*a* and 4*a*, which form part of a drive mechanism 5 mounted on stacking module E. Extension arms 3*a* and 4*a* are biased to the left (see FIG. 2) by respective helical springs 6 and 7 compressed between the frame B of the drive mechanism 5 and respective seats formed by shoulders 3*b* and 4*b* on extension arms 3*a* and 4*a*.

The ends of extension arms 3*a* and 4*a* opposite to the ends attached to slide mechanisms 3 and 4 terminate in respective cylindrical couplers 8 and 9 formed of plastic material such as PETP. At the end of couplers 8 and 9 are respective semicylindrical receptacles 8*a* and 9*a*, which are pressed against respective complementary projections 10 and 11, of a drive cradle 12. The cradle is secured to a shaft 13 which is pivotally mounted about an axis perpendicular to the plane including the longitudinal axes of extension arms 3*a* and 4*a*. The axes of rotation of the projections 10, 11 extend parallel to the axis of the shaft 13 couplers 8, 9 are thus retained in place by the pressure exerted by springs 6 and 7.

When drive cradle 12 moves on shaft 13, projections 10 and 11 describe arcs of a circle around the axis of the shaft 13. Since projections 10 and 11 engage the respective semicylindrical receptacles 8*a* and 9*a*, the couplers 8, 9 can freely slide against the end faces of respective extension arms 3*a* and 4*a*, and thus impart linear reciprocating motion thereto.

Shaft 13 is operated to oscillate around its axis of rotation as described below. Consequently, when shaft 13 moves drive cradle 12 in the counterclockwise direction toward the position shown in FIG. 2, extension arm 4*a*, slide mechanism 4 and alignment device 2 are driven 3 and alignment device 1 are driven to the left by the force of compressed spring 6. This separates the alignment devices, and allows an additional blank to be added to stack P.

Conversely, when shaft 13 moves cradle 12 in the clockwise direction, extension arm 3*a* , slide mechanism 3 and alignment device 1 are driven to the right against the force of spring 7. At the same time, extension arm 4*a*, slide mechanism 4 and alignment device 2 are driven to the left by the force of compressed spring 7. This closes the space between the alignment devices and exerts pressure on opposite sides of stack P to align a newly added blank with the rest of the stack.

The shaft 13 is secured to a lever 14 (FIG. 1) which is jointed to an end of a connecting rod 15 whose other end is connected to an excentric 16 secured to a driving wheel 19 attached to the shaft of a motor 17 by a transmission belt 18. The lever 14 includes a plurality of openings 14*a* at which connecting rod 15 may be attached to lever 14. In this way, the amplitude of the movement of the lever 14 and hence the oscillating angle of the drive shaft 13 and of cradle 12 may be varied.

Because receptacles 8*a* and 9*a* of couplers 8 and 9 are pressed in elastic manner against projections 10 and 11 of drive cradle 12 by the springs 6 and 7, no clearance can appear as a result to the wear of the pieces. The synchronism of the displacement of alignment devices 1 and 2 by the motion of slide mechanisms 3 and 4, and extension arms 3*a* and 4*a* is thus maintained, since any wear is taken up by springs 6 and 7 which permanently maintain the contact between projections 10 and 11, and receptacles 8*a* and 9*a*.

Although the present invention has been described in relation to a particular embodiment thereof, many other variations and modifications and other uses will become apparent to those skilled in the art. It is intended, therefore, that the present invention be limited not by the specific disclosure herein, but only by the appended claims.

What is claimed is:

1. A device for aligning a stack of flat workpieces having opposite parallel faces comprising:

first and second alignment devices disposed on opposite sides of a space in which the stack of workpieces is to be aligned, and operable to simultaneously apply and release opposed forces to the stack;

first and second arm mechanisms connected respectively to the first and second alignment devices;

first and second resilient positioning elements that respectively bias the first and second arm mechanisms such that the first alignment device applies force to the stack, and the second alignment device does not apply force to the stack;

a drive mechanism coupled to the arm mechanisms to impart simultaneous linear motion thereto in opposite directions, the drive mechanism including:

a drive shaft pivotable about an axis, a transverse member secured to the drive shaft, and pivotable therewith, the transverse member including first and second projections that travel in a reciprocating arcuate path relative to the drive shaft as the transverse member pivots; and first and second couplers extending respectively from the ends of the arm mechanisms opposite the alignment devices, each coupler being shaped to receive a complementary portion of one of the projections therein, and to permit rotational relative motion therebetween, but being restrained by the first and second resilient positioning elements respectively to maintain contact at all times with the first and second projections.

2. A device according to claim 1, wherein the arm mechanisms move parallel to each other in a plane and the projections on the transverse member move in the same plane as the arm mechanisms.

3. A device according to claim 1, wherein the projections on the transverse member are of semicylindrical cross-section and the couplers include semicylindrical recesses which receive the projections, whereby the projections move reciprocally on an arcuate path and the couplers move reciprocally on linear paths in opposite directions.

4. A device according to claim 3, wherein the couplers are comprised of a body of plastic material fixed to the end of each of the arm mechanism.

5. A device according to claim 4, wherein the plastic material is PETP.

6. A device according claim 4, wherein the couplers are held in place between the ends of the arm mechanisms and the projections on the transverse member by the force of the respective resilient positioning elements.

7. A device according to claim 1, wherein the couplers are comprised of a body of plastic material fixed to the end of each of the arm mechanism.

8. A device according to claim 1, wherein the plastic material is PETP.

9. A device according claim 1, wherein the couplers are held in place between the ends of the arm mechanisms and the projections on the transverse member by the force of the respective resilient positioning elements.

* * * * *